US008905401B2

(12) United States Patent
Nakagaki

(10) Patent No.: US 8,905,401 B2
(45) Date of Patent: Dec. 9, 2014

(54) PRINTING MEDIUM CONVEYING DEVICE AND IMAGE FORMING APPARATUS

(71) Applicant: Toshihiro Nakagaki, Ibaraki (JP)

(72) Inventor: Toshihiro Nakagaki, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/905,665

(22) Filed: May 30, 2013

(65) Prior Publication Data

US 2013/0320616 A1 Dec. 5, 2013

(30) Foreign Application Priority Data

May 31, 2012 (JP) ..... 2012-125343
May 31, 2012 (JP) ..... 2012-125344
Apr. 19, 2013 (JP) ..... 2013-088609

(51) Int. Cl.
*B65H 9/04* (2006.01)
*B65H 9/00* (2006.01)

(52) U.S. Cl.
CPC ..... *B65H 9/004* (2013.01)
USPC ..... 271/246; 271/228; 271/245

(58) Field of Classification Search
CPC ..... B65H 9/004; B65H 9/06; B65H 7/02; B65H 2404/144; B65H 2701/1311; B65H 2220/01; B65H 2220/02
See application file for complete search history.

(56) References Cited

U.S. PATENT DOCUMENTS 7,467,793 B2 12/2008 Tanabe
7,731,188 B2 * 6/2010 deJong et al. ..... 271/273
8,047,537 B2 * 11/2011 deJong et al. ..... 271/228
8,317,192 B2 * 11/2012 Karikusa et al. ..... 271/243
8,376,358 B2 * 2/2013 deJong et al. ..... 271/228
8,419,013 B2 * 4/2013 Muneyasu et al. ..... 271/246
2005/0206072 A1 * 9/2005 Tanabe ..... 271/226
2008/0003031 A1 * 1/2008 Tsuchiya et al. ..... 399/361
2008/0232879 A1 * 9/2008 Shoji et al. ..... 399/395
2010/0150631 A1 6/2010 Kobayashi
2010/0158594 A1 6/2010 Kobayashi

FOREIGN PATENT DOCUMENTS

JP 06-138736 5/1994
JP 06-191686 7/1994
JP 08-157107 6/1996
JP 10-316276 12/1998
JP 2000-136051 5/2000
JP 2003-276910 10/2003
JP 2005-272021 10/2005
JP 3804936 5/2006
JP 2006-256803 9/2006
JP 2008-024507 2/2008
JP 2010-070270 4/2010

(Continued)

*Primary Examiner* — Kaitlin Joerger
(74) *Attorney, Agent, or Firm* — Cooper & Dunham LLP

(57) ABSTRACT

The present device includes a conveying path, a contact member coming in contact with the front of a printing medium to stop the conveyance of the medium, a hold member holding the front of the medium having contacted with the contact member, a first conveying unit conveying the medium so as to abut the contact member to form slack on the medium between itself and the hold member holding the medium, and a second conveying unit being provided nearer to the hold member than the first conveying unit in the conveying direction and conveying the medium so as to abut the contact member to form the slack. The second conveying unit is movable so that a part thereof existing on the side where the slack is formed on the medium in the conveying path is moved to the outside of the conveying path.

11 Claims, 8 Drawing Sheets

(56) References Cited

FOREIGN PATENT DOCUMENTS

| | | |
|---|---|---|
| JP | 2010-070272 | 4/2010 |
| JP | 2010-143663 | 7/2010 |
| JP | 2010-149975 | 7/2010 |
| JP | 2011-111308 | 6/2011 |
| JP | 2011-126684 | 6/2011 |
| JP | 2011-126685 | 6/2011 |
| JP | 2011-126698 | 6/2011 |

* cited by examiner

FIG.8

(a) SHEET TYPE K1

| | SHEET LENGTH L>L1+Lbf | SHEET LENGTH L≦L1+Lbf |
|---|---|---|
| SHEET THICKNESS T1 | FIG. 3 | FIG. 2 |
| SHEET THICKNESS T2 | FIG. 3 | FIG. 2 |
| SHEET THICKNESS T3 | FIG. 3 | FIG. 2 |
| SHEET THICKNESS T4 | FIG. 3 | FIG. 2 |
| ⋮ | ⋮ | ⋮ |

(b) SHEET TYPE K2

| | SHEET LENGTH L>L1+Lbf | SHEET LENGTH L≦L1+Lbf |
|---|---|---|
| SHEET THICKNESS T1 | FIG. 2 | FIG. 2 |
| SHEET THICKNESS T2 | FIG. 3 | FIG. 2 |
| SHEET THICKNESS T3 | FIG. 3 | FIG. 2 |
| SHEET THICKNESS T4 | FIG. 3 | FIG. 2 |
| ⋮ | ⋮ | ⋮ |

(c) SHEET TYPE Kn

| | SHEET LENGTH L>L1+Lbf | SHEET LENGTH L≦L1+Lbf |
|---|---|---|
| SHEET THICKNESS T1 | FIG. 2 | FIG. 2 |
| SHEET THICKNESS T2 | FIG. 2 | FIG. 2 |
| SHEET THICKNESS T3 | FIG. 3 | FIG. 2 |
| SHEET THICKNESS T4 | FIG. 3 | FIG. 2 |
| ⋮ | ⋮ | ⋮ |

PRINTING MEDIUM CONVEYING DEVICE AND IMAGE FORMING APPARATUS

CROSS-REFERENCE TO RELATED APPLICATIONS

The present application claims priority to and incorporates by reference the entire contents of Japanese Patent Application No. 2012-125343 filed in Japan on May 31, 2012, Japanese Patent Application No. 2012-125344 filed in Japan on May 31, 2012 and Japanese Patent Application No. 2013-088609 filed in Japan on Apr. 19, 2013.

BACKGROUND OF THE INVENTION

1. Field of the Invention

The present invention relates to a printing medium conveying device and an image forming apparatus.

2. Description of the Related Art

In conventional image forming apparatuses, sheets such as documents and recording sheets are sequentially conveyed by a printing medium conveying device from a paper cassette to a sheet ejection unit. The printing medium conveying device includes a conveying path including a plurality of guiding members and a plurality of rollers that are driven to rotate, through which sheets are conveyed.

Once a printing operation is started, toner images formed in four colors (yellow, magenta, cyan, and black) image carriers are transferred to an intermediate transfer belt. Sheets that have been fed from the paper cassette one by one are conveyed through the conveying path to a secondary transfer device, where the toner images on the intermediate transfer belt are transferred to the sheet. The toner images are then fixed to the sheet in a fixing unit, and after that the sheet is ejected from the printing medium conveying device to outside the apparatus.

A skew correction device is provided in the conveying path for correcting the skew of the sheet occurred during the conveyance. The skew correction device abuts the leading edge of the sheet to the guiding member to align the position of the leading edge of the sheet to correct the position of the sheet so as to be parallel to a secondary transfer device. Specifically, by feeding the sheet excessively between a roller for the skew correction and a conveying roller located in the upstream thereof, the leading edge of the sheet is abutted to the guiding member. To align the sheet as described above, a space is required for forming slack on the sheet that has been fed due to evacuation of the sheet from the conveying path. For that purpose, sufficient distances and spaces need to be ensured between the rollers. In addition, if the used sheet is more rigid and thicker, larger distances between the rollers need to be ensured.

In recent years, however, the need has increased for a printer and other image forming apparatuses to cope with various types of sheet, print on a rigid thick sheet and print on a short-sized sheet such as a post card with a single printer or apparatus.

When slack is formed on a sheet between rollers using a skew correction device, for example, if the rollers are arranged with a short distance interposed therebetween, the conveying roller cannot feed a rigid thick sheet excessively due to the hardness of the sheet. To address such an issue, as disclosed in Japanese Patent Application Laid-open No. 2008-024507, for example, a mechanism is provided to separate a pair of rollers in the vertical direction and convey the sheet using other conveying rollers provided on the upstream thereof. With this structure, the sheet does not contact with the separated rollers, whereby slack is formed on the sheet along the long pitch between the upstream rollers and the rollers for the skew correction. The separation operation of rollers is performed, however, in a short time and typically for a few millimeters. The separation distance is too short to ensure a space to form sufficient slack on the sheet, causing an obstacle for feeding the sheet.

In view of the circumstances above, there is needed to provide a printing medium conveying device capable of ensuring a space for feeding sheets of different lengths to correct the direction of the sheets when printing media are conveyed.

SUMMARY OF THE INVENTION

It is an object of the present invention to at least partially solve the problems in the conventional technology.

According to the present invention, there is provided: a printing medium conveying device comprising: a conveying path serving as a path through which a printing medium is conveyed; a contact member configured to come in contact with the front part of the printing medium in the sheet conveying direction to stop conveyance of the printing medium; a hold member configured to hold the front part of the printing medium that has contacted with the contact member; a first conveying unit configured to convey the printing medium so as to abut the contact member between the first conveying unit and the hold member that holds the printing medium; and a second conveying unit configured to be provided nearer to the hold member than the first conveying unit in the sheet conveying direction and convey the printing medium so as to abut the contact member between the second conveying unit and the hold member that holds the printing medium.

In the above-mentioned printing medium conveying device, the second conveying unit is configured to be movable so that a part thereof existing on a side where slack is formed on the printing medium due to the conveyance in the conveying path is moved to outside of the conveying path.

The present invention also provides an image forming apparatus comprising the above-mentioned printing medium conveying device.

The present invention also provides a printing medium conveying device comprising: a conveying path serving as a path through which a printing medium is conveyed; a contact member configured come in contact with the front part of the printing medium in the sheet conveying direction to stop conveyance of the printing medium; a hold member configured to hold the front part of the printing medium that has contacted with the contact member; a first conveying unit configured to convey the printing medium so as to abut the contact member to form slack on the printing medium between the first conveying unit and the hold member that holds the printing medium; and a detachable unit in which a second conveying unit is detachable and provided nearer to the hold member than the first conveying unit in the sheet conveying direction and conveys the printing medium so as to abut the contact member to form slack on the printing medium between the detachable unit and the hold member that holds the printing medium.

The present invention also provides an image forming apparatus comprising the above-mentioned printing medium conveying device.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 8 is a table listing conditions of the second conveying unit of the image forming apparatus according to the first embodiment, used for each type of sheet;

DETAILED DESCRIPTION OF THE PREFERRED EMBODIMENTS

Figure 1:
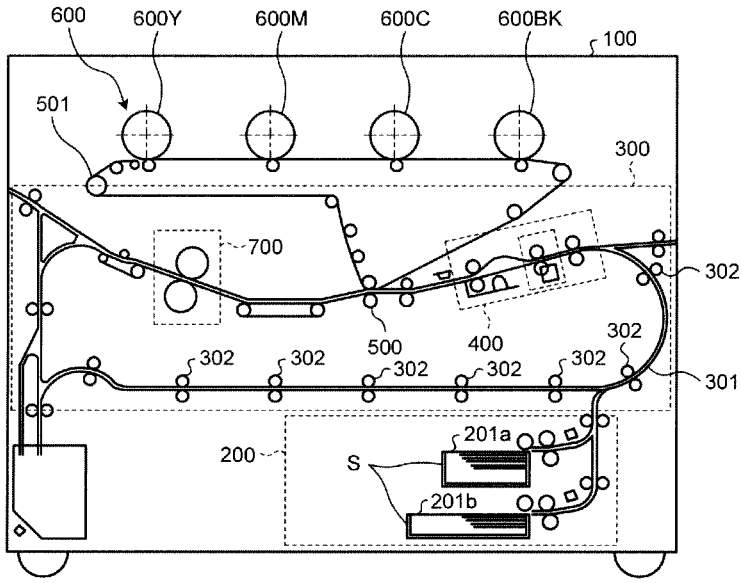
FIG. 1 is a side view of an image forming apparatus according to a first embodiment of the present invention.

FIG. 1 is a cross-sectional side view of an image forming apparatus including a printing medium conveying device according to an embodiment of the present invention. As illustrated in FIG. 1, an image forming apparatus 100 includes a feeding device 200, a printing medium conveying device 300, a skew correction device 400, a secondary transfer device 500, an image carrier 600, and a fixing unit 700.

The image carrier 600 includes four colors image carriers 600Y (yellow), 600M (magenta), 600C (cyan), and 600Bk (black). The image forming apparatus 100 includes an intermediate transfer belt 501. Toner images formed on the image carriers 600Y, 600M, 600C, and 600Bk are transferred to the intermediate transfer belt 501.

The feeding device 200 feeds a sheet S from a paper cassette 201*a* or a paper cassette 201*b* to the printing medium conveying device 300. A plurality of sheets S are stacked in the paper cassettes 201*a* and 201*b*. The sheet S fed from the feeding device 200 is conveyed to the printing medium conveying device 300 that includes a conveying path 301 and a pair of conveying rollers 302. The sheet S is conveyed through the conveying path 301 formed by guide plates. The conveying path 301 has a structure that sandwiches the sheet S between the guide plates from above and below the sheet S. A plurality of pairs of conveying rollers 302 are provided along the conveying path 301 and driven to rotate around a rotating shaft, thereby conveying the sheet S held between the pairs of conveying rollers.

Figure 2:
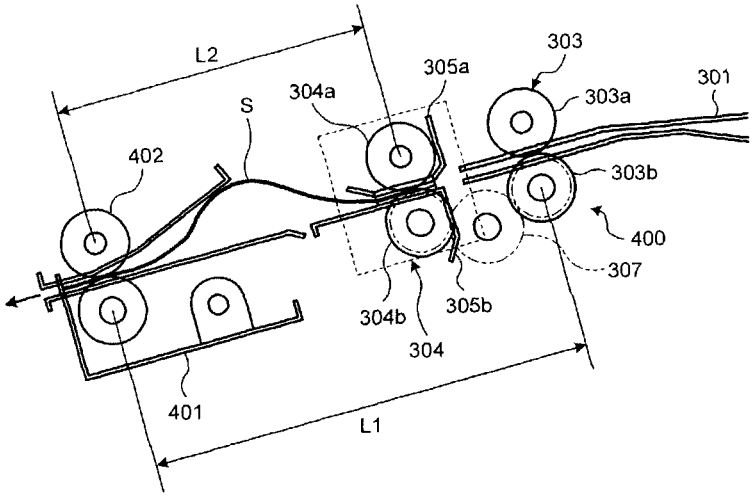
FIG. 2 is a side view of a skew correction device according to the first embodiment.

FIG. 2 is a detailed side view of the skew correction device 400. As illustrated in FIG. 1, the printing medium conveying device 300 includes the skew correction device 400. The skew correction device 400 includes a first conveying unit 303, a second conveying unit 304, a contact member 401, and a hold member 402.

The first conveying unit 303 and the second conveying unit 304 convey the sheet S for aligning the sheet S. The first conveying unit 303 includes rollers 303*a* and 303*b*. The rollers 303*a* and 303*b* protrude into the conveying path 301 from holes formed in the guide plates forming the conveying path 301. The second conveying unit 304 includes rollers 304*a* and 304*b*, and guiding members 305*a* and 305*b*. The guiding members 305*a* and 305*b* guide the sheet S from above and below the sheet S and control the direction of the sheet S in the same manner as the guide plates forming the conveying path 301. The guiding members 305*a* and 305*b* are standalone, that is to say, disconnected from the guide plates of the conveying path 301. Holes are formed in the guiding members 305*a* and 305*b*, from which the rollers 304*a* and 304*b* protrude into the conveying path 301.

The guiding members 305*a* and 305*b* of the second conveying unit 304 are coupled to each other. The second conveying unit 304 is supported rotatably around the roller 304*b* on the opposite side from the side where slack is formed on the sheet S in the conveying path 301.

The first conveying unit 303 and the second conveying unit 304 are driven by a common driving force transmission unit 307. The driving force transmission unit 307 contacts both one of the rollers of the first conveying unit 303 and one of the rollers of the second conveying unit 304, whereby the rotational force of the driving force transmission unit 307 is transmitted to both one of the rollers of the first conveying unit 303 and one of the rollers of the second conveying unit 304. It is permissible that the driving force transmission unit 307 itself does not rotate, instead, the rotation of the first conveying unit 303 is transmitted through the driving force transmission unit 307 to the second conveying unit 304.

The contact member 401 comes in contact with the front part of the sheet S in the sheet conveying direction, thereby stopping the conveyance of the sheet S. In the present embodiment, the contact member 401 is formed in such a shape that the guide plate is bent to protrude into the conveying path 301. After the sheet S comes in contact with the contact member 401, the first conveying unit 303 or the second conveying unit 304 conveys the sheet S for a predetermined distance and temporarily stops the conveyance of the sheet S. The first conveying unit 303 or the second conveying unit 304 resumes the conveyance of the sheet S in synchronization with the conveyance of the images transferred on the intermediate transfer belt 501 to their predetermined positions. At this time, the contact member 401 evacuates downward, whereby the sheet S is conveyed. The contact member can also be achieved as a "nip abutting structure" in which the contact point of a later-described hold member 402 comes in contact with the sheet S. With this structure, a common member is used for both the contact member and the hold member.

The hold member 402 is a pair of rollers that holds the front part of the sheet S in the sheet conveying direction. The skew correction device 400 forms slack on the sheet between the hold member 402 and the first conveying unit 303 or the hold member 402 and the second conveying unit 304 when the first conveying unit 303 or the second conveying unit 304 conveys the sheet S so as to abut the contact member 401. This corrects skew feed of the sheet. As illustrated in FIG. 2, the second conveying unit 304 is provided so that slack is formed on the sheet S within the distance L2 between the hold member 402 and the second conveying unit 304. This aligns the sheet 5, which will be further conveyed to the secondary transfer device 500. The secondary transfer device 500 transfers the toner images formed on the intermediate transfer belt 501 to the sheet S. The fixing unit 700 then fixes the toner images transferred on the sheet S, and the sheet S is ejected from the image forming apparatus 100.

Figure 3:
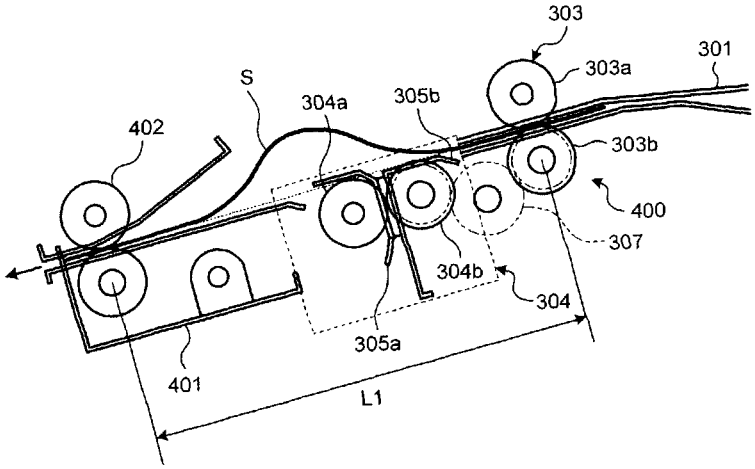
FIG. 3 is a side view of the skew correction device when a second conveying unit according to the first embodiment has been moved to another position.

FIG. 3 is a side view of the printing medium conveying device 300 when the second conveying unit 304 has been moved to the outside of the conveying path 301. When printing is performed and if the length of the sheet S selected as a print sheet for the image forming apparatus 100 is larger than the roller pitch L1 between the hold member 402 and the first conveying unit 303, the roller 304*a* and the guiding member 305*a* of the second conveying unit 304 are rotated around the rotating shaft of the roller 304*b* forward in the sheet conveying direction. The rotation of the second conveying unit 304 moves the roller 304*a* and the guiding member 305*a* to the outside of the conveying path 301 from the side where the slack is formed on the sheet S in the conveying path 301. After the second conveying unit 304 is rotated, the other surfaces of the guiding members 305*a* and 305*b* face the conveying path 301, which is capable of guiding the sheet S being conveyed in the conveying path 301. FIG. 3 illustrates that the second conveying unit 304 is rotated by approximately 90 degrees, however, the angle is not limited to this example. Other angles may be used by appropriately setting a folded and bent member of the guiding member or the guiding members.

Figure 4:
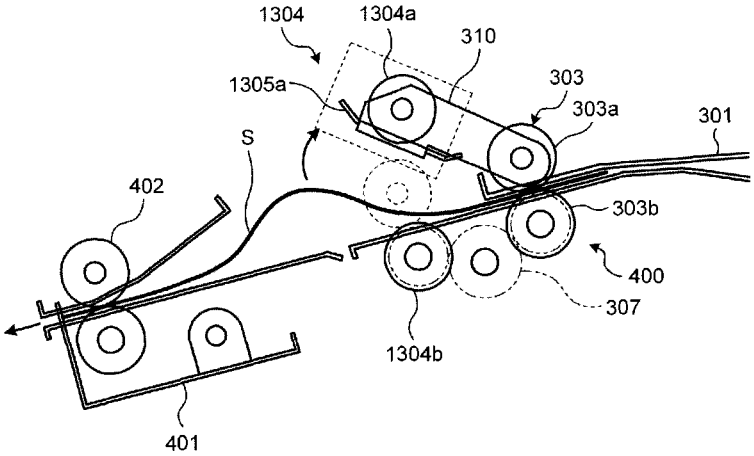
FIG. 4 is a side view of the skew correction device when a second conveying unit according to the first embodiment has been moved to another position.

FIG. 4 is a side view of another structure of the second conveying unit. As illustrated in FIG. 4, the second conveying unit 1304 includes rollers 1304*a* and 1304*b*, and a guiding member 1305*a*. In the structure illustrated in FIG. 4, the roller 1304*b* protrudes from the guide plate included in the conveying path 301. The roller 1305*a* is coupled to the roller 303*a* of the first conveying unit 303 by a guide plate 310. The guide plate 310 can rotate around the rotating shaft of the roller 303*a* of the first conveying unit 303. As illustrated in FIG. 4, the roller 1304*a* and the guiding member 1305*a* are moved to the upper side (e.g., rotated by approximately 45 degrees as illustrated in FIG. 4) so as not to obstruct the formation of the slack on the sheet S.

Figure 5:
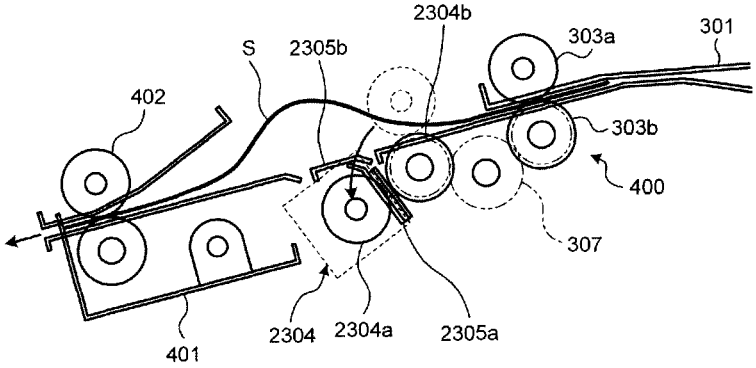
FIG. 5 is a side view of the skew correction device when a second conveying unit according to the first embodiment has been moved to another position.

FIG. 5 is a side view of still another structure of the second conveying unit after moved. As illustrated in FIG. 5, the second conveying unit 2304 includes rollers 2304*a* and 2304*b*, and guiding members 2305*a* and 2305*b*. In the structure illustrated in FIG. 5, the roller 2304*b* protrudes from the guide plate included in the conveying path 301. The rollers 2304*a* and 2304*b* of the second conveying unit 2304 are coupled to each other. The second conveying unit 2304 is supported rotatably around the roller 2304*b* on the opposite side from the side where slack is formed on the sheet S in the conveying path 301. The angle of this rotation is larger than the example illustrated in FIG. 3. After the guiding member 2305*b* is moved, the rotation angle is adjusted so that the guiding member 2305*b* is positioned along the conveying path 301. In addition, the guiding member 2305*b* can be removed, for example, so as not to obstruct the rotation of the second conveying unit 2304.

Figure 6:
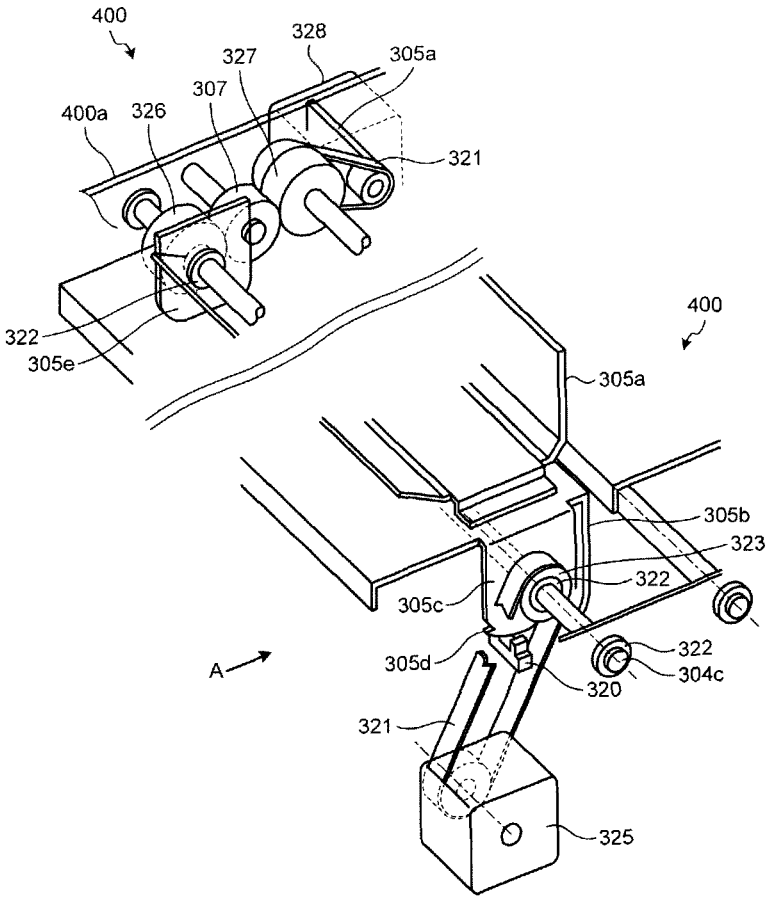
FIG. 6 is a perspective view of an end of the second conveying unit according to the first embodiment.
Figure 7:
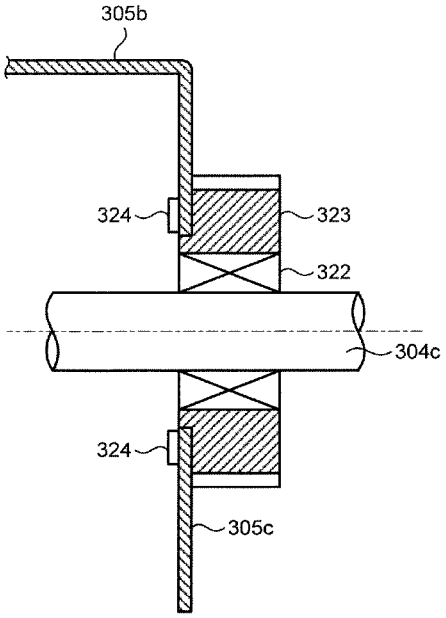
FIG. 7 is a cross-sectional structural view of a bent member of a guide plate of the second conveying unit according to the first embodiment viewed from the arrow A illustrated in FIG. 6.

The unit for moving the second conveying unit will now be described with reference to FIGS. 6 and 7. FIG. 6 is a perspective view of an end of the second conveying unit 304. FIG. 7 is a cross-sectional structural view of a bent member 305*c* of the guiding member 305*b* viewed from the arrow A illustrated in FIG. 6. As illustrated in FIG. 6, the bent member 305*c* is formed, and a pulley 323 and a shaft bearing 322 are provided on an end of the guiding member 305*b*. The pulley 323 and shaft bearing 322 are formed integrally by press fitting in advance. As illustrated in the cross-sectional view of FIG. 7, the flange of the pulley 323 is fitted and inserted into the hole of the bent member 305*c* and fixed with a fixing member 324 such as a screw. A shaft 304*c* of the second conveying roller 304*b* is inserted into the shaft bearing 322 and supported by the frame 400*a* of the skew correction device 400. In the same manner, on the opposite side, the shaft 304*c* of the second conveying roller 304*b* is inserted into a bent member 305*e* through the shaft bearing 322, and a gear 326 is fastened to the shaft 304*c* or inserted detently into the shaft 304*c*. The shaft 304*c* is supported by the frame 400*a* of the skew correction device 400 at the further back position through the shaft bearing 322. The second conveying unit 304 is supported rotatably around the shaft 304*c*.

For driving to convey a printing medium, a driving unit 328 is mounted on the frame 400*a* of the skew correction device 400. The rotating drive force is transmitted from the driving unit 328 through a belt 321 to a gear 327. This drives the first conveying roller 303*b* of the first conveying unit 303 to convey the sheet S. The rotating drive force is also transmitted from the driving unit 328 through a gear 307 to the gear 326. This drives the second conveying roller 304*b* to rotate to convey the sheet S. In this manner, the first conveying unit 303 and the second conveying unit 304 are driven to convey the sheet S at the same time.

A driving unit 325 (a drive unit) and a sensor 320 are fixed to the frame 400*a* of the skew correction device 400 or the frame (not illustrated) of the secondary transfer device 500 and independent from the rotatable second conveying unit. The rotating drive force of the driving unit 325 drives the pulley 323 to rotate through the belt 321, whereby the second conveying unit 304 can rotate. The bent member 305*c* has a feeler member 305*d* serving as a shield plate for the sensor 320 in response to the rotation of the second conveying unit 304. The driving unit 325 drives or stops the forward and backward rotation of the driving unit 325 depending on whether the signal of the sensor is shielded or not. As a result, the driving unit 325 controls the second conveying unit 304 to move to either the state illustrated in FIG. 2 or the state illustrated in FIG. 3. Specifically, when the sensor 320 detects the feeler member 305*d* the signal is shielded. This controls the second conveying unit 304 to be moved to the outside of the conveying path 301.

The control method for the driving unit 325 is not limited to this example. When an AC stepping motor is used, the driving unit 325 may be controlled by counting pulses determined in advance during the forward or backward rotation of the driving unit 325. When the rotation angle of the second conveying unit 304 can be physically restricted in the state illustrated in FIG. 2 or the state illustrated in FIG. 3 with a stopper and so on, the driving unit 325 may be controlled by being driven or being stopped in response to detection of overcurrent of a DC motor.

When a typical printing operation is started, an operator selects the size, the thickness, the type (e.g. a plain sheet, a coated sheet, an envelope, a punched sheet) of the sheet S that has been loaded in the feeding device 200 through a not-illustrated operation panel in advance. When a typical standard size sheet is used such as an A4-sized sheet or an A3-sized sheet, the width and length of the sheet can be determined from the size information selected by the operator. When a non-standard form size sheet is used, the width and length of the sheet can be directly input by the operator. According to the length information of the sheet, the second conveying unit 304 selects the state illustrated in FIG. 2 or the state illustrated in FIG. 3 to be used for starting a printing operation. FIG. 8 is a table that lists positional information of the second conveying unit 304 that is determined according to the combination of the thickness, the length, and the type of the sheet. This table is stored in a hard disk or other storage in the image forming apparatus.

For example, as illustrated in FIG. 8, when the length of the sheet is L and the length of the slack formed during the skew correction is Lbf, and L>L1+Lbf, the state illustrated in FIG. 3 is selected. When L≤L1+Lbf, the state illustrated in FIG. 2 is selected. The state can be selected according to the combination of the thickness of the sheet and the type of the sheet in addition to the length of the sheet L. For example, when the thickness of the sheet is T and the type of the sheet is K, the matrix illustrated in FIG. 8 is stored in advance in a not-illustrated storage device. According to the obtained sheet information, the matching condition is selected from the conditions listed in FIG. 8, whereby the state illustrated in FIG. 2 or the state illustrated in FIG. 3 is selected to be used for starting a printing operation. The information on the length, the thickness, and the types of the sheet can be obtained according to the information selected by a user, and can alternatively be obtained by measurement.

In the printing medium conveying device 300 as described above, if it is not required to print on a short-sized sheet such as a post card, the skew correction device 400 can be used in a state where the second conveying unit 304 is moved to the outside of the conveying path 301. In this state, a sheet whose length is smaller than the roller pitch L1 between the first conveying unit 303 and the hold member 402 cannot be conveyed. When the length of a sheet is equal to or larger than L1, the sheet can be conveyed. The guiding member 305*a* provides sufficient space for forming slack on the sheet, whereby the skew correction of the sheet can be performed even if a rigid sheet is used.

When printing on a short-sized sheet, the skew correction device 400 can be used in a state where the second conveying unit 304 is moved to the inside of the conveying path 301. In this state, the sheet S whose length is equal to or smaller than the roller pitch L2 between the second conveying unit 304 and the hold member 402 can be conveyed. The short-sized sheet that could not be conveyed without the second conveying unit 304 can be, therefore, conveyed.

With the movable structures as described above, there is no need to provide a drive system or a structure to perform control for changing the position of a conveying unit. The second conveying unit 304 can be moved according to a user's demand without increasing the cost of the device, whereby printing on a short-sized sheet such as a post card and a rigid thick sheet can be achieved. As a result, the image forming apparatus capable of coping with various lengths of the sheet can be provided.

In addition to the movable structures as described above in which the second conveying unit 304 is rotated, other methods can be applied. For example, the second conveying unit can be moved upward or to the right or to the left to be evacuated from the position where the slack is formed on the conveying path 301. The space for the second conveying unit to move in the image forming apparatus need to be ensured, with this structure.

The second conveying unit can be controlled to move rather than manually moved. This can be achieved by determining whether the second conveying unit is moved according to the size of the sheet specified when printing is instructed by a user and controlling the driving device of the second conveying unit as necessary.

Second Embodiment

Figure 9:
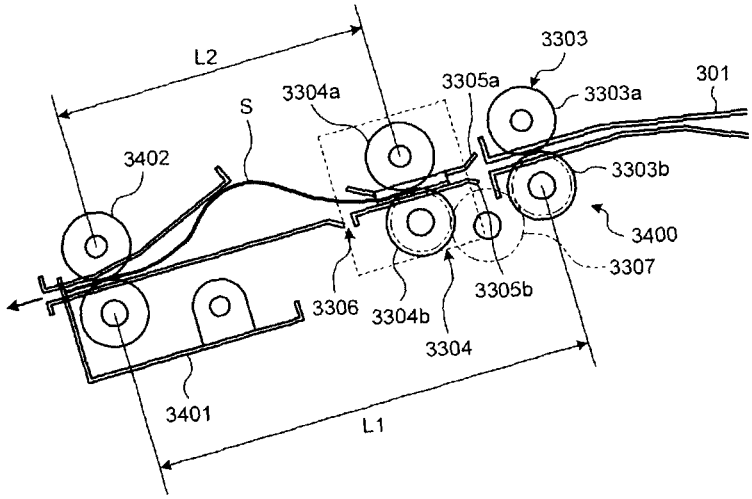
FIG. 9 is a side view of a skew correction device according to a second embodiment of the present invention.

A second embodiment will now be described. The second embodiment differs from the first embodiment in that the second conveying unit is provided detachably. The second embodiment is described hereinafter with reference to the drawings. FIG. 9 is a detailed side view of a skew correction device 3400. As illustrated in FIG. 9, the printing medium conveying device 300 includes a first conveying unit 3303, a second conveying unit 3304, and a skew correction device 3400. The skew correction device 3400 includes the first conveying unit 3303, the second conveying unit 3304, a contact member 3401, and a hold member 3402.

The first conveying unit 3303 and the second conveying unit 3304 convey the sheet S for aligning the sheet S. The first conveying unit 3303 includes rollers 3303*a* and 3303*b*. The rollers 3303*a* and 3303*b* protrude into the conveying path 301 from the holes formed in the guide plates forming the conveying path 301. The second conveying unit 3304 includes rollers 3304*a* and 3304*b*, and guiding members 3305*a* and 3305*b*. The guiding members 3305*a* and 3305*b* guide the sheet S from above and below in the same manner as the guide plates forming the conveying path 301. The guiding members 3305*a* and 3305*b* are standalone, that is to say, disconnected from the guide plates of the conveying path 301. Holes are formed in the guiding members 3305*a* and 3305*b*, from which the rollers 3304*a* and 3304*b* protrude into the conveying path 301.

A detachable mechanism 3306 with the detachable second conveying unit 3304 is provided in the printing medium conveying device 300. In the detachable mechanism 3306, a guide plate is not provided on the part where the second conveying unit 3304 is mounted in the conveying path 301, whereby a space is formed into which the second conveying unit 3304 is fitted. The second conveying unit 3304 is fixed to the printing medium conveying device 300 by a fastening unit (not-illustrated) such as a screw, for example. The second conveying unit 3304, therefore, can be removed and mounted manually.

The first conveying unit 3303 and the second conveying unit 3304 are driven by a common driving force transmission unit 3307. The driving force transmission unit 3307 contacts one of the rollers of the first conveying unit 3303 and one of the rollers of the second conveying unit 3304, whereby the rotational force of the driving force transmission unit 3307 is transmitted to both one of the rollers of the first conveying unit 3303 and one of the rollers of the second conveying unit 3304. This structure with a common drive unit can be achieved without an additional driving unit or control unit, thereby reducing the cost on the device. It is permissible that the driving force transmission unit 3307 itself does not rotate, instead, the rotation of the first conveying unit 3303 is transmitted through the driving force transmission unit 3307 to the second conveying unit 3304.

The contact member 3401 comes in contact with the front part of the sheet S in the sheet conveying direction, thereby aligning the leading edge of the sheet S so as to be parallel to the contact member 3401. In the present embodiment, the contact member 3401 is formed in such a shape that the guide plate is bent to protrude into the conveying path 3301. After the sheet S comes in contact with the contact member 3401, the first conveying unit 3303 or the second conveying unit 3304 conveys the sheet S for a predetermined distance and temporarily stops the conveyance of the sheet S. The first conveying unit 3303 or the second conveying unit 3304 resumes the conveyance of the sheet S in synchronization with the conveyance of the images transferred on the intermediate transfer belt 501 to their predetermined positions. At this time, the contact member 3401 evacuates downward, whereby the sheet S is conveyed. The contact member can also be achieved as a "nip abutting structure" in which the contact point of a later-described hold member 3402 comes in contact with the sheet S. With this structure, a common member is used for both the contact member 3401 and the hold member 3402.

The hold member 3402 is a pair of rollers that holds the front part of the sheet S in the sheet conveying direction. The skew correction device 3400 forms slack on the sheet between the hold member 3402 and the first conveying unit 3303 or the hold member 3402 and the second conveying unit 3304 when the first conveying unit 3303 or the second conveying unit 3304 conveys the sheet S so as to abut the contact member 3401. This corrects skew feed of the sheet. As illustrated in FIG. 9, the second conveying unit 3304 is provided so that the slack is formed on the sheet S within the distance L2 between the hold member 3402 and the second conveying unit 3304. This aligns the sheet S, which will be further conveyed to the secondary transfer device 500. The secondary transfer device 500 transfers the toner images formed on the intermediate transfer belt 501 to the sheet S. The fixing unit 700 then fixes the toner images transferred on the sheet S, and the sheet S is ejected from the image forming apparatus 100.

Figure 10:
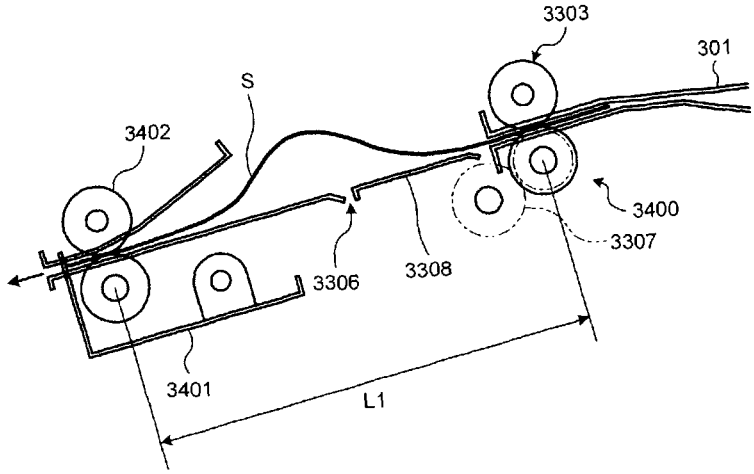
FIG. 10 is a side view of the skew correction device when a second conveying unit according to the second embodiment has been removed.
Figure 11:
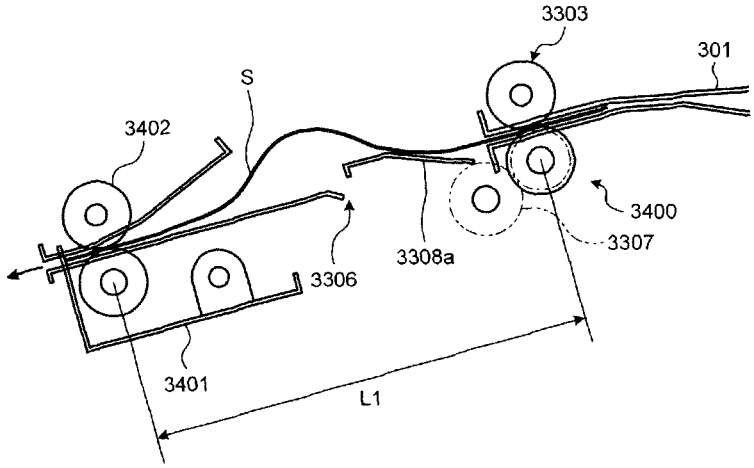
FIG. 11 is a side view of the skew correction device when the second conveying unit according to the second embodiment has been removed.

FIG. 10 is a side view of the skew correction device 3400 when the second conveying unit 3304 has been removed. As illustrated in FIG. 10, after removing the second conveying unit 3304, another member, that is, a guiding member 3308 is mounted so as to cover the space in the detachable mechanism 3306. The guiding member 3308 is formed nearly parallel to the conveying path 301, however, the guiding member 3308*a* may be formed in a shape protruding to the side where the slack is formed on the sheet S, as illustrated in FIG. 11. With this structure, the slack can be readily formed on the sheet S with the guiding member 3308*a* as a starting point.

In the example illustrated in FIG. 10, the second conveying unit 3304 does not exist, therefore, the slack is formed on the sheet S within the distance L1 between the first conveying unit 3303 and the hold member 3402. The distance L1 is larger than the L2 illustrated in FIG. 9, therefore, the slack can also be formed on the sheet S whose length is larger than in a state where the second conveying unit 3304 exists.

Figure 12:
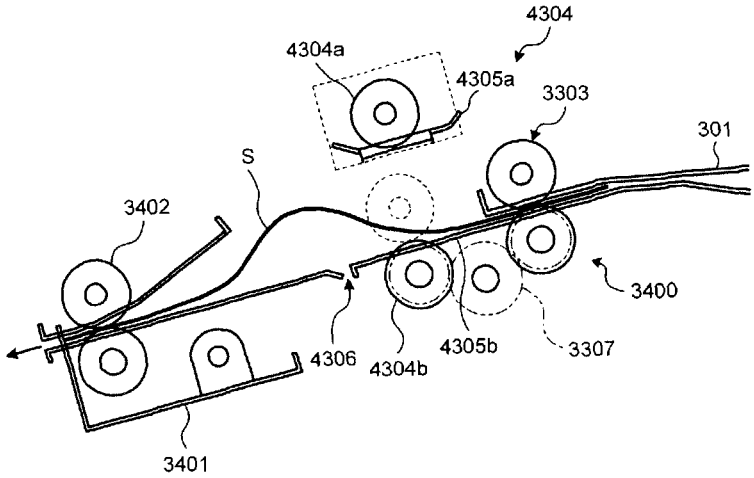
FIG. 12 is a side view of the skew correction device when the second conveying unit according to the second embodiment has been removed.

FIG. 12 is a side view of another removal method of the second conveying unit. As illustrated in FIG. 12, the second conveying unit 4304 includes the rollers 4304*a* and 4304*b*, and guiding members 4305*a* and 4305*b* in the printing medium conveying device. The guiding member 4305*b* is formed integrally with the guide plate included in the conveying path 301. The roller 4304*b* and the guiding member 4305*b* cannot be removed from a detachable unit 4306. On the other hand, the roller 4304*a* and the guiding member 4305*a* can be removed from the detachable unit 4306. That is, in this example, only the part of the second conveying unit 4304 on the side where the slack is formed on the sheet S can be removed.

In the printing medium conveying device 300 as described above, if it is not required to print on a short-sized sheet such as a post card, the skew correction device 3400 can be used in a state illustrated in FIG. 10. In this state, the sheet whose length is smaller than the roller pitch L1 between the first conveying unit 3303 and the hold member 3402 cannot be conveyed. When the length of a sheet is equal to or larger than L1, the sheet can be conveyed. The guiding member 3308 provides sufficient space for forming slack on the sheet, whereby the skew correction can be performed even if a rigid sheet is used.

When printing on a short-sized sheet, the skew correction device 3400 can be used with the structure illustrated in FIG. 9. With this structure, the sheet S whose length is equal to or smaller than the roller pitch L2 between the second conveying unit 3304 and the hold member 3402 can be conveyed. The short-sized sheet that could not be conveyed without the second conveying unit 3304 can be, therefore, conveyed.

With the detachable structure as described above, there is no need to provide a drive system or the structure to perform control for changing the position of the conveying unit. The second conveying unit 3304 can be moved according to a user's demand without increasing the cost of the device, whereby printing on a short-sized sheet such as a post card and printing on a rigid thick sheet can be achieved. As a result, the image forming apparatus capable of coping with various lengths of the sheet can be provided.

According to a printing medium conveying device of the present invention, a space for feeding sheets of different lengths can be ensured to correct the direction of the sheets when printing media are conveyed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A printing medium conveying device comprising:

a conveying path serving as a path through which a printing medium is conveyed;

a contact member configured to come in contact with the front part of the printing medium in the sheet conveying direction to stop conveyance of the printing medium;

a hold member configured to hold the front part of the printing medium that has contacted with the contact member;

a first conveying unit configured to convey the printing medium so as to abut the contact member between the first conveying unit and the hold member that holds the printing medium; and a second conveying unit configured to be provided nearer to the hold member than the first conveying unit in the sheet conveying direction and convey the printing medium so as to abut the contact member between the second conveying unit and the hold member that holds the printing medium, wherein the second conveying unit is configured to be movable to a second position so that a part thereof existing on a side where slack is formed on the printing medium due to the conveyance in the conveying path is moved to outside of the conveying path and the second conveying unit does not convey the printing medium while in the second position, wherein the second conveying unit comprises a guiding member that guides the printing medium in the sheet conveying direction and the guiding member comprises a leading member that leads the printing medium to the side where the slack is formed on the printing medium in the conveying path of the second conveying unit when a part existing on the side where the slack is formed is moved to outside of the conveying path, wherein the second conveying unit comprises a pair of rollers provided above and below the printing media and the second conveying unit configured to be provided rotatably around the rotating shaft of one of the pair of rollers on the side where the slack is not formed on the printing medium.

2. The printing medium conveying device according to claim 1, wherein the guiding member is configured to be capable of guiding the printing medium when a part existing on the side where the slack is formed on the printing medium in the conveying path of the second conveying unit is located inside or outside of the conveying path.

3. A printing medium conveying device comprising:

a conveying path serving as a path through which a printing medium is conveyed;

a contact member configured to come in contact with the front part of the printing medium in the sheet conveying direction to stop conveyance of the printing medium;

a hold member configured to hold the front part of the printing medium that has contacted with the contact member;

a first conveying unit configured to convey the printing medium so as to abut the contact member between the first conveying unit and the hold member that holds the printing medium; and a second conveying unit configured to be provided nearer to the hold member than the first conveying unit in the sheet conveying direction and convey the printing medium so as to abut the contact member between the second conveying unit and the hold member that holds the printing medium, wherein the second conveying unit is configured to be movable to a second position so that a part thereof existing on a side where slack is formed on the printing medium due to the conveyance in the conveying path is moved to outside of the conveying path and the second conveying unit does not convey the printing medium while in the second position, wherein the second conveying unit comprises a guiding member that guides the printing medium in the sheet conveying direction and the guiding member comprises a leading member that leads the printing medium to the side where the slack is formed on the printing medium in the conveying path of the second conveying unit when a part existing on the side where the slack is formed is moved to outside of the conveying path, a feeler member on at least an end of the guiding member of the second conveying unit; and a sensor on a position where the feeler member is detected.

4. The printing medium conveying device according to claim 3, wherein when the sensor detects the feeler member, a signal is shielded, and the shielding of the signal prompts the second conveying unit to be controlled to move to the outside of the conveying path.

5. A printing medium conveying device comprising:

a conveying path serving as a path through which a printing medium is conveyed;

a contact member configured to come in contact with the front part of the printing medium in the sheet conveying direction to stop conveyance of the printing medium;

a hold member configured to hold the front part of the printing medium that has contacted with the contact member;

a first conveying unit configured to convey the printing medium so as to abut the contact member between the first conveying unit and the hold member that holds the printing medium;

a second conveying unit configured to be provided nearer to the hold member than the first conveying unit in the sheet conveying direction and convey the printing medium so as to abut the contact member between the second conveying unit and the hold member that holds the printing medium, wherein the second conveying unit is configured to be movable to a second position so that a part thereof existing on a side where slack is formed on the printing medium due to the conveyance in the conveying path is moved to outside of the conveying path and the second conveying unit does not convey the printing medium while in the second position;

a length obtaining unit configured to obtain the length of the printing medium in the sheet conveying direction;

a determination unit configured to determine whether the obtained length is equal to or larger than a predetermined threshold;

a drive unit configured to drive the second conveying unit so that a part existing on the side where the slack is formed on the printing media in the conveying path of the second conveying unit is located in the conveying path of the second conveying unit when it is determined that the length is smaller than the predetermined threshold, and drive the second conveying unit so that the part existing on the side where the slack is formed in the conveying path of the second conveying unit is located outside of the conveying path when it is determined that the length is equal to or larger than the predetermined threshold; and a storage unit configured to store therein positional information of the second conveying unit determined according to a combination of length information and thickness information of the printing medium; and a thickness obtaining unit configured to obtain the thickness information of the printing medium, wherein the drive unit determines a position to which the second conveying unit is moved with reference to the storage unit according to the obtained length information of the printing medium and the obtained thickness information of the printing medium, and controls the second conveying unit to move to inside or outside of the conveying path.

6. A printing medium conveying device comprising:

a conveying path serving as a path through which a printing medium is conveyed;

a contact member configured to come in contact with the front part of the printing medium in the sheet conveying direction to stop conveyance of the printing medium;

a hold member configured to hold the front part of the printing medium that has contacted with the contact member;

a first conveying unit configured to convey the printing medium so as to abut the contact member between the first conveying unit and the hold member that holds the printing medium;

a second conveying unit configured to be provided nearer to the hold member than the first conveying unit in the sheet conveying direction and convey the printing medium so as to abut the contact member between the second conveying unit and the hold member that holds the printing medium, wherein the second conveying unit is configured to be movable to a second position so that a part thereof existing on a side where slack is formed on the printing medium due to the conveyance in the conveying path is moved to outside of the conveying path and the second conveying unit does not convey the printing medium while in the second position;

a length obtaining unit configured to obtain the length of the printing medium in the sheet conveying direction;

a determination unit configured to determine whether the obtained length is equal to or larger than a predetermined threshold;

a drive unit configured to drive the second conveying unit so that a part existing on the side where the slack is formed on the printing media in the conveying path of the second conveying unit is located in the conveying path of the second conveying unit when it is determined that the length is smaller than the predetermined threshold, and drive the second conveying unit so that the part existing on the side where the slack is formed in the conveying path of the second conveying unit is located outside of the conveying path when it is determined that the length is equal to or larger than the predetermined threshold;

a storage unit configured to store therein positional information of the second conveying unit determined according to a combination of length information of the printing medium, thickness information of the printing medium, and type information of the printing medium;

a thickness obtaining unit configured to obtain the thickness information of the printing medium; and a type obtaining unit configured to obtain the type information of the printing medium, wherein the drive unit determines a position to which the second conveying unit is moved with reference to the storage unit according to the obtained length information of the printing medium, the obtained thickness information of the printing medium, and the obtained type information of the printing medium, and controls the second conveying unit to move to inside or outside of the conveying path.

7. An image forming apparatus comprising the printing medium conveying device according to claim 1.

8. The printing medium conveying device according to claim 3, wherein the guiding member is configured to be capable of guiding the printing medium when a part existing on the side where the slack is formed on the printing medium in the conveying path of the second conveying unit is located inside or outside of the conveying path.

9. An image forming apparatus comprising the printing medium conveying device according to claim 3.

10. An image forming apparatus comprising the printing medium conveying device according to claim 5.

11. An image forming apparatus comprising the printing medium conveying device according to claim 6.

* * * * *